United States Patent [19]

Bockenstette, II

[11] 3,945,572

[45] Mar. 23, 1976

[54] ROTATING ATOMIZER NOZZLE

[76] Inventor: Joseph A. Bockenstette, II, P.O. Box 227, Abilene, Kans. 67410

[22] Filed: Feb. 10, 1975

[21] Appl. No.: 548,805

[52] U.S. Cl. ..... 239/171; 239/233; 239/424; 239/570

[51] Int. Cl.[2]... B05B 1/30; B05B 3/02; B05B 17/02

[58] Field of Search ..... 239/171, 214, 225, 231, 239/233, 214.13, 214.19, 222.11, 222.17, 381–383, 403, 410, 424, 463, 476, 482, 490, 491, 570

[56] References Cited

UNITED STATES PATENTS

| | | | |
|---|---|---|---|
| 2,512,782 | 6/1950 | Strickland | 239/225 X |
| 3,429,510 | 2/1969 | Taylor | 239/171 |
| 3,452,931 | 7/1969 | Knowles | 239/171 X |
| 3,552,652 | 1/1971 | Greenwood | 239/214.13 X |
| 3,618,857 | 11/1971 | Rautenbach et al. | 239/171 X |
| 3,684,177 | 8/1972 | Barlow | 239/171 |
| 3,762,649 | 10/1973 | Dalhaus | 239/171 X |

FOREIGN PATENTS OR APPLICATIONS

| | | | |
|---|---|---|---|
| 244,118 | 3/1963 | Australia | 239/171 |

*Primary Examiner*—Robert S. Ward, Jr.
*Attorney, Agent, or Firm*—Cushman, Darby & Cushman

[57] ABSTRACT

A spray nozzle for mounting on an aircraft which controls droplet size comprises a bonnet section having a flexible diaphragm for permitting passage of spray material through a channel and outwardly through one of a plurality of selectively positionable orifices of varying cross-section for further passage through a flexible connection to a rotating cage assembly actuated by air flow impinging upon mounted fan blades for dispensing the spray material in relatively constant sized droplets for spreading over a large swath of crop terrain.

7 Claims, 1 Drawing Figure

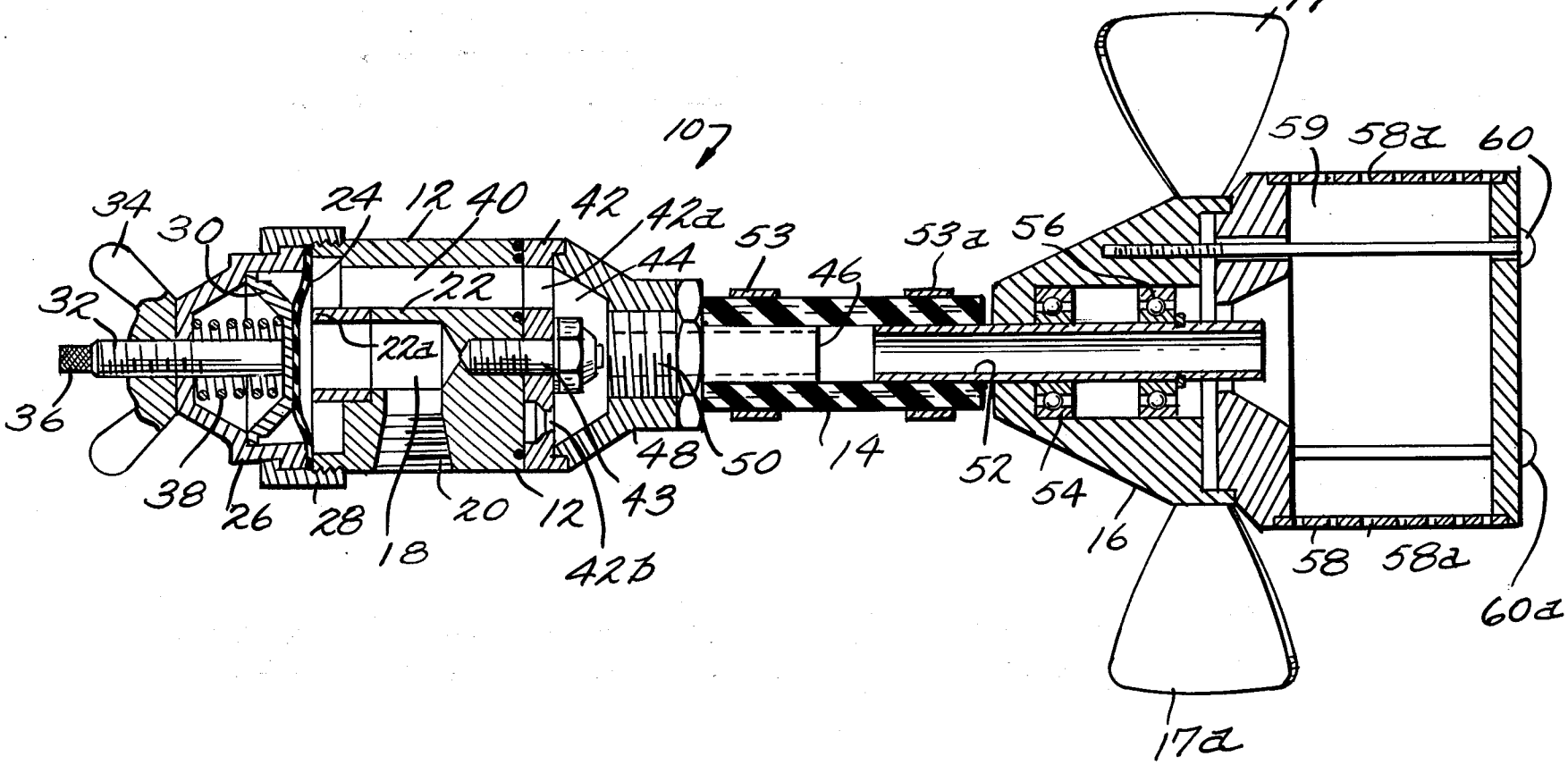
60
60a
58a
58a
59
58
17
17a
16
56
54
52
53a
46
14
53
50
107
42a
44
48
43
42
42b
12
40
22
20
12
22a
18
24
28
26
30
38
34
32
36

ROTATING ATOMIZER NOZZLE

BACKGROUND OF THE INVENTION

A. Field of the Invention

The present invention relates to crop-spraying equipment and more particularly to a nozzle which is secured to a boom fixed aircraft used to spray or dust crops.

Typically, in a fixed-wing aircraft, the boom is secured to the trailing edge of the wings. The boom incorporates a plurality of spray nozzles affixed thereto and serves as a passageway for a liquid pesticide or economic poison which is discharged through the nozzles for spreading over a swath of crops, timber, other agricultural products or pest habitats. If a helicopter rather than a fixed-wing aircraft is used, the boom is attached to the fuselage or body of the craft.

The spray nozzle of the present invention is designed to correctly apply various pesticides to growing agricultural products. In order for correct application to occur, the "drift" must be accurately controlled. Drift refers to the spreading out of a released pesticide from a spray nozzle. Drift may occur from a complex of indicia, i.e., speed and attitude of the aircraft, wind conditions, the rate of discharge from the spray nozzle, etc. The present invention is directed to providing a spray droplet of relatively constant size issuing from the nozzle so that the drift may be readily controlled.

Accordingly, the spray nozzle of the present invention is adapted to be mounted upon a boom and incorporates a flexible diaphragm for allowing pesticide to be channeled into one of a plurallty of selectively adjustable orifices located in a rotatably arranged discharge device. After the liquid pesticide passes through such a selected orifice at a predetermined flow rate, it is directed through a flexible connecting tube to a rotating cage dispenser. The rotating cage dispenser is actuated by means of air flow striking fan blades arranged on the dispenser. The dispenser further comprises a meshed cylindrical cage assembly driven by the fan blades. The meshed cage determines the droplet size of spray to be discharged during rotation of the case assembly. Centrifugal force propels the pesticide through the meshed cage during rotation thereof.

It has been found that by controlling the quantity of spray and the droplet size, the drift of spray issuing from a nozzle may also be correspondingly controlled. Some or all of the following methods of control may also be employed with regulating quantity of spray and droplet size to further enhance control of drift: (1) using foam as a spray material; (2) rearranging nozzle location; (3) varying flying attitude; (4) compensating for meterological conditions; (5) redesigning mechanical nozzle, and (6) using stringing or polymerizing agents.

B. Description of the Prior Art

Prior art devices have dealt extensively with providing various types of valves to be used in spray nozzles. One such prior art device is disclosed in U.S. Pat. No. 2,639,194 which describes an anti-drip valve for spray nozzles. The valve utilizes a rubber diaphragm which is actuated by pressure from a liquid to be sprayed. The diaphragm is displaced from a closing position over a tube to permit spray to be channeled through the tube into a strainer and outwardly through a discharge passageway. While the diaphragm provides for an efficient sealing construction to prevent dripping of spray from the nozzle, there is no disclosure of providing an adjustable metering device for varying the rate of discharge of liquid spray. Thus, such a valve would not enable a spray nozzle to have the capability of selectively varying droplet size of a sprayed pesticide and therefore would not permit the control of spray drift from a nozzle.

An adjustable turret spray nozzle is disclosed in U.S. Pat. No. 3,596,835. Here, a spray nozzle is employed as part of a crop spraying system and incorporates a rotatable plate having a plurality of differently sized orifices for alignment with a discharge passage of a spray nozzle. A passage leads from a liquid spray source to spiral passageways which impart a turbulent flow to the liquid being discharged through a selected orifice in the rotatable plate. Thus, a rather small amount of liquid spray may be discharged in a spiral swirling path by means of the spiral passageways. However, this patent does not disclose a rotating cage assembly used in conjunction with the orifices in the rotatable plate. Therefore, it is apparent that the adjustable turret spray nozzle would not dispense insecticides or emulsions over relatively wide areas of crops or terrain.

A device for dispensing spray from a moving vehicle which incorporates a propeller driven hollow chamber is disclosed in U.S. Pat. No. 3,398,893. This patent describes the use of a meshed screen which is rotatably driven by a propeller. The propeller is activated by air flow impinging thereon when a vehicle is moving at a certain speed. The material to be sprayed is directly passed from a source through a tube into the rotating spray dispenser. It is apparent that this spray dispensing device does not enable the specific rate of discharge of spray material to be adjustably controlled unless there is an exchange of differently sized rotatable meshed spray dispenser chambers.

SUMMARY OF THE INVENTION

The present invention is directed to providing a rotating atomizer nozzle which incorporates a flexible diaphragm for permitting spray material to be channeled through a passageway in a bonnet to one of a plurality of selectively arrangeable orifices in a metering plate so that the spray material may be further dispensed at a regulated rate to a cage assembly rotated by means of air impinging upon fan blades for spraying pesticide droplets of a relatively constant size over a relatively wide swath of crop terrain. The rotating atomizer nozzle of the present invention regulates both quantity and droplet size of pesticide spray.

Another object of the present invention is to provide a rotating atomizer nozzle which incorporates a flexible connection or tubing between the selectively adjustable metering plate and the rotatable cage assembly. The flexible connection serves as a means for absorbing shock or vibration from the aircraft or moving vehicle which could be transmitted from the head portion of the spray nozzle to the rotating cage assembly. The flexible connection or tubing also serves to dampen vibrations from the rotating cage assembly to the bonnet which may result from cage imbalance, gyroscopic precession, etc. Furthermore, the flexible hose connection provides for a connection which may be readily removed between a head portion or bonnet of the valve and the rotating cage assembly. By removing a hose clamp, one rotating cage assembly may be replaced for another.

Another object of the present invention is to provide a rotating atomizer nozzle having a head portion or bonnet which incorporates an adjustable metering plate for selection of an orifice for discharging spray fluid under pressure from an anti-drip diaphragm inlet.

Yet a further object of the present invention is to provide a rotating atomizer nozzle which enables spray material to be discharged at a predetermined rate from one of a plurality of selectively positionable orifices to a rotating dispenser. Droplet size of spray issuing from the dispenser is controlled by the size of wire mesh in the dispenser. With droplet size being maintained relatively constant, and with the quantity of spray also being regulated, the drift of spray material from the rotating cage assembly may, in turn, be controlled so that a uniform swath of spray may be spread over agricultural crops.

Still another object of the present invention is to provide a rotating atomizer nozzle which may be secured to a boom by means of a small adapter which does not require special support brackets.

Additional objects of the spray nozzle of the present invention reside in the specific construction of the exemplary apparatus hereinafter particularly described in the specification and shown in the drawing.

BRIEF DESCRIPTION OF THE DRAWING

Novel features of the improved rotating atomizer spray nozzle of the present invention will be more readily understood from a consideration of the following description taken together with the accompanying drawing, in which a preferred adaptation is illustrated with the various parts thereof identified by suitable reference characters and in which:

The drawing is a cross-sectional view taken longitudinally through the spray nozzle of the present invention and illustrates the construction of an inlet passage leading from a diaphragm through a passageway which directs spray material through a selected orifice in a rotatable metering plate for dispensing spray material through a flexible hose and outwardly from a rotating cage assembly.

DETAILED DESCRIPTION OF THE INVENTION

With reference to the drawing, the spray nozzle of the present invention is generally designated at 10. Spray nozzle 10 is comprised essentially of three sections, i.e., a head section 12 flexibly connected by means of hose 14 to rotating cage assembly 16. Head section 12 is secured to a boom at the trailing edge of an aircraft wing by means of a boom adapter (not shown) which directs spray fluid upwardly through port 18. Port 18 is provided with threads 20 to enable the boom adapter to be threadedly secured thereto. Port 18 is contained within a tube 22 formed integrally with head section 12 for contacting a diaphragm 24. Diaphragm 24 is secured to head section 12 by means of an external cap 26 which is rigidly disposed against diaphragm 24 and head section 12 by means of a threaded locking clamp 28.

The drawing illustrates the spray nozzle of the present invention in the operating or open position. The open position is maintained by loosening wing nut 34 and screw 32 to enable slidable pressure member 30 to be urged to the left against spring 38 by diaphragm 24 when sufficient spray pressure is maintained through port 18. Screw 32 further serves as a locking means when it is desired not to operate the nozzle.

When no spray pressure is transferred to diaphragm 24, spring 38 biases slidable pressure member 30 against diaphragm 24 which in turn tightly fits against seat 22*a*. To ensure that no leakage past seat 22*a* occurs, screw 32 may be turned inwardly to hold slidable pressure member 30 securely against diaphragm 24 and seat 22*a*. Wing nut 34 is provided to prevent screw 32 from working loose and a knurled surface 36 enables screw 32 to be readily turned.

The above described anti-drip shut-off features of the spray nozzle are necessary to prevent spray fluid from leaking past seat 22*a* when the nozzle is not in operation, i.e., during transport of the aircraft from one spraying site to another.

With slidable pressure member 30 arranged in the open position as shown in the drawing, spray material may be transported through passageway 18 until it contacts diaphragm 24. If the spray material is at sufficient pressure, i.e., approximately 15–20 psi., diaphragm 24 will be lifted from seat 22*a* of tube 22 to enable the spray material to be transported through channel 40. Disposed at the downward end of channel 40 and rotatably secured to head section 12 is selective metering plate 42 which is secured to an actuating cap 48. Rotatable metering plate 42 has a circular periphery, and is provided with a plurality of different sized orifices such as 42*a* and 42*b* shown in the drawing. It is contemplated that as many as eight different orifices be disposed on metering plate 42 so that a variety of spray discharge rates may be selected. Metering plate 42 and actuator cap 48 are secured to head section 12 by means of a bolt 43. In order to vary the discharge rate of spray fluid under pressure from channel 40, metering plate 42 may be disposed by turning cap 48 in a plurality of positions so that a predetermined orifice opening such as 42*a* or 42*b* may be selectively aligned with channel 40. With a selected orifice aligned with passage channel 40, spray material under pressure is displaced through the orifice into chamber 44 and outwardly through tube 46. Tube 46 is secured to cap 48 by means of a hollow screw or bolt 50. Tube 46 communicates with support shaft 52 by means of a flexible connection 14. Flexible tube connection 14 is secured to tube 46 and support shaft 52 by means of clamping members 53 and 53a.

A rotatable supporting assembly 16 is disposed upon support shaft 52 by means of bearings 54 and 56. A hollow cylindrical cage assembly 58 is connected to rotatable assembly 16 by means of elongated securing bolts 60 and 60*a*. Fan blade members 17 and 17a are connected to rotatable assembly 16 by any conventional means.

Cage assembly 58 comprises a two-ply screen assembly. A first woven mesh inner screen of stainless steel wire is arranged interiorly of an outer screen of stainless steel sheet. With spray nozzle 10 mounted onto a boom of an airplane or other moving vehicle, air will strke fan blades 17 and 17*a* and thus impart rotation to cage assembly 58. Spray material under pressure will travel at a predetermined discharge rate from an orifice in metering plate 42 through support shaft 52 into chamber area 59 of rotating cage assembly 58. Centrifugal force will displace the spray droplets outwardly through the plurality of apertures 58*a* formed in the external circumferences of rotatable cage assembly 58. The spray droplets are of a relatively constant size as determined by apertures 58*a* and also are dispensed at a predetermined rate because of the selective positioning of metering plate 42. Furthermore, the droplets are thrown or spread from rotatable cage assembly 58 in a relatively wide path so that a wide swath of crop terrain may be sprayed or dusted. It can be readily appreciated that the spray nozzle of the present invention provides for a wide dispensing of spray material under pressure. Thus, the number of spray nozzles may be significantly reduced for a specific spraying application if the spray nozzle of the present invention is employed. Because the droplet size and discharge rate of the spray may be selectively controlled, the drift of the dispensed spray may also be controlled. Metering plate 42 may be rotated to preselect an orifice for alignment with channel 40 to compensate for various weather conditions, speed of the aircraft or terrain desired to be sprayed.

While the present invention has been shown and described in a preferred form, a person having ordinary skill in the art can readily recognize that changes may be made therein without departing from the spirit and scope of the present invention, the scope of which is to be determined by the appended claims.

What is claimed is:

1. A spray nozzle for use on a moving vehicle comprising:

diaphragm means disposed adjacent to an inlet tube and movable between open and closed positions with respect to said inlet tube, said open position being maintained by a predetermined spray pressure within said inlet tube urging said diaphragm means away therefrom to permit the passage of spray material from said inlet tube to an adjacent downstream channel;

selectively positionable orifice means alignable with said channel for permitting spray material to be transported from said channel through a preselected orifice so that spray material passing therefrom flows at a predetermined discharge rate; and flexible connecting means for transporting spray material passing from said orifice means to a cage assembly having fan blades, said cage assembly being rotatably supported upon a shaft which is in turn supported by said flexible connecting means so that when air of a sufficient velocity impinges upon said fan blades said cage assembly rotates about said shaft and thereby dispenses spray material outwardly therefrom.

2. A spray nozzle as defined in claim 1 wherein said selectively positionable orifice means comprises a metering plate having a plurality of orifices each of which has a different cross-sectional flow opening, said metering plate being positionable by means of a hand turnable actuator secured thereto, said actuator including a chamber which leads to said flexible connecting means.

3. A spray nozzle as defined in claim 2 wherein a slidable pressure member is disposed adjacent to said diaphragm, an adjustable screw means being arranged to position said slidable pressure member against said diaphragm to prevent leakage when said diaphragm is disposed in said closed position.

4. A spray nozzle as defined in claim 2 wherein said flexible connecting means comprises a hose having one end disposed over a tube emerging from said actuator and the other end disposed over said shaft, said shaft being hollow to permit spray material to be transported therethrough from said hose inwardly to said cage assembly.

5. A spray nozzle as defined in claim 4 wherein said cage assembly comprises a portion secured to bearings which are rotatably journalled upon said hollow shaft.

6. A spray nozzle as defined in claim 5 wherein said rotatable cage assembly comprises an inner mesh screen disposed within a perforated outer screen, said screens being located downstream from said fan blades.

7. A spray nozzle for use on a moving vehicle comprising:

diaphragm means disposed adjacent to an inlet tube and movable between open and closed positions with respect to said inlet tube, said open position being maintained by a predetermined spray pressure within said inlet tube urging said diaphragm means away therefrom to permit the passage of spray material from said inlet tube to an adjacent downstream channel;

selectively positionable orifice means alignable with said channel for permitting spray material to be transported from said channel through a preselected orifice so that spray material passing therefrom flows at a predetermined discharge rate; and a cage assembly having fan blades, said cage assembly being connected to said orifice means and rotatably supported upon a shaft so that when air of a sufficient velocity impinges upon said blades said cage assembly rotates about said shaft and thereby dispenses spray material outwardly therefrom.

* * * * *